US012139975B2

(12) United States Patent
Menger

(10) Patent No.: US 12,139,975 B2
(45) Date of Patent: Nov. 12, 2024

(54) HYDROSTATICALLY-ACTUATABLE SYSTEMS AND RELATED METHODS

(71) Applicant: D-TECH UK LTD, Almondsbury (GB)

(72) Inventor: Christian Menger, Houston, TX (US)

(73) Assignee: D-TECH UK LTD, Almondsbury (GB)

( * ) Notice: Subject to any disclaimer, the term of this patent is extended or adjusted under 35 U.S.C. 154(b) by 2 days.

(21) Appl. No.: 17/757,449

(22) PCT Filed: Dec. 16, 2020

(86) PCT No.: PCT/IB2020/062072

§ 371 (c)(1),
(2) Date: Jun. 15, 2022

(87) PCT Pub. No.: WO2021/124173

PCT Pub. Date: Jun. 24, 2021

(65) Prior Publication Data

US 2023/0017429 A1 Jan. 19, 2023

Related U.S. Application Data

(60) Provisional application No. 62/948,688, filed on Dec. 16, 2019.

(51) Int. Cl.

| | |
|---|---|
| ***E21B 17/10*** | (2006.01) |
| ***E21B 23/04*** | (2006.01) |
| ***E21B 47/01*** | (2012.01) |

(52) U.S. Cl.

CPC ..... *E21B 17/1014* (2013.01); *E21B 23/04* (2013.01); *E21B 47/01* (2013.01)

(58) Field of Classification Search

CPC ..... E21B 17/1014; E21B 23/04; E21B 47/01
See application file for complete search history.

(56) References Cited

U.S. PATENT DOCUMENTS 3,080,924 A * 3/1963 Baker ..... E21B 23/04115 166/241.1
3,131,769 A * 5/1964 John ..... E21B 23/04115 166/212

(Continued)

FOREIGN PATENT DOCUMENTS

| | | |
|---|---|---|
| EP | 0961008 | 12/1999 |
| GB | 2328746 | 3/1999 |

(Continued)

OTHER PUBLICATIONS

International Search Report and Written Opinion regarding International Application No. PCT/IB2020/062072, 10 pages, dated Feb. 12, 2021.

(Continued)

*Primary Examiner* — Steven A MacDonald
(74) *Attorney, Agent, or Firm* — Norton Rose Fulbright US LLP

(57) ABSTRACT

A system, such as a bottom hole assembly, having a central body (18), at least one hydrostatically-actuatable assembly (50) configured to extend radially outward from the central body (18), the hydrostatically-actuatable assembly (50) having at least one N piston body (76) exposed to hydrostatic pressure; a plurality of passive structures (54), each of which is: configured to extend radially outward from the central body (18); and circumferentially spaced from the at least one hydrostatically-actuatable assembly (50) and another one of the plurality of passive structures.

20 Claims, 4 Drawing Sheets

(56) References Cited

U.S. PATENT DOCUMENTS

| | | | | |
|---|---|---|---|---|
| 3,448,805 | A * | 6/1969 | Brown | E21B 23/04 166/212 |
| 4,681,160 | A * | 7/1987 | Fineberg | E21B 23/04 166/212 |
| 4,691,779 | A * | 9/1987 | McMahan | E21B 49/001 166/321 |
| 5,181,576 | A * | 1/1993 | Askew | E21B 17/1014 175/73 |
| 6,488,104 | B1 | 12/2002 | Eppink et al. | |
| 9,249,632 | B2 * | 2/2016 | Lakkashetti | E21B 17/1078 |
| 9,657,537 | B2 * | 5/2017 | Riley | E21B 17/1042 |
| 2004/0035199 | A1 * | 2/2004 | Meister | E21B 49/088 73/152.22 |
| 2004/0237640 | A1 * | 12/2004 | Meister | E21B 49/006 73/152.48 |
| 2010/0206581 | A1 * | 8/2010 | Chambers, II | E21B 17/10 166/243 |
| 2011/0000665 | A1 * | 1/2011 | Chesnutt | E21B 17/1007 166/241.1 |

FOREIGN PATENT DOCUMENTS

| | | | | |
|---|---|---|---|---|
| RU | 2600809 | | 10/2016 | |
| WO | WO 2011/002841 | | 1/2011 | |
| WO | WO 2013/082376 | | 6/2013 | |
| WO | WO-2013082376 | A1 * | 6/2013 | E21B 17/1014 |

OTHER PUBLICATIONS

Search Report issued in corresponding Russian Application No. 2022119557, dated Apr. 22, 2024 (English Translation provided).

* cited by examiner

HYDROSTATICALLY-ACTUATABLE SYSTEMS AND RELATED METHODS

CROSS REFERENCE TO RELATED APPLICATIONS

This application is a 371 National Application of International Application No. PCT/IB2020/062072, filed Dec. 16, 2020, which claims the benefit of priority of U.S. Provisional Patent Application No. 62/948,688, filed Dec. 16, 2019, which are hereby incorporated by reference in their entirety.

BACKGROUND OF THE INVENTION

The present invention relates generally to drilling systems and, more particularly to downhole drilling tools.

1. Field of Invention

The present invention relates generally to drilling systems and, more particularly to downhole drilling tools.

2. Description of Related Art

Wells are generally drilled into the ground or ocean bed to recover natural deposits of oil and gas, as well as other desirable materials that are trapped in geological formations in the Earth's crust. A well may be drilled using a drill bit attached to the lower end of a drill string. Drilling mud may be pumped down through the drill string to the drill bit. The drilling mud lubricates and cools the drill bit, and it carries drill cuttings back to the surface in an annulus between the drill string and the borehole wall.

For successful oil and gas exploration, it is beneficial to control the direction of drilling and to collect information about the subsurface formations that are penetrated by a borehole. For example, to control the direction of drilling, rotary steerable systems (RSS) are frequently used in drilling applications to allow accurate wellbore placement along a predetermined path. Information collected about the subsurface formation can include measurements of the formation pressure and formation permeability. These measurements may be used for predicting the production capacity and production lifetime of a subsurface formation.

Techniques for measuring formation properties using tools and devices that are positioned near the drill bit in a drilling system have been developed. Thus, formation measurements are made during the drilling process, and the terminology generally used in the art is "MWD" (measurement-while-drilling) and "LWD" (logging-while-drilling). MWD refers to measuring the drill bit trajectory, as well as borehole temperature and pressure, while LWD refers to measuring formation parameters or properties, such as resistivity, porosity, permeability, and sonic velocity, among others. Real-time data, such as the formation pressure, allows the drilling entity to make decisions about drilling mud weight and composition, as well as decisions about drilling rate and weight-on-bit, during the drilling process.

Tools and devices related to RSS, MWD, and LWD can include mechanical and/or electronic components to conduct measurements, provide power, and control the wellbore creation process. The internal components are typically contained in cylindrical pipes that can be pressure sealed to protect them from high hydrostatic pressures present within the wellbore. Further, the internal components need to be constrained within the collars to minimize the risk of damage due to shock and vibration during the wellbore creating process.

Traditionally, the internal components are mounted to a collar by means of through-bolts in the drill pipe and/or collar. This technique, however, introduces a weak-spot in the drill pipe and/or collar by creating a stress concentration from which fatigue cracks can originate under bending or torsional loading.

Another traditional solution to this problem has been the use of a locking nut that applies axial pressure on the internal components to lock them inside the collar against a fixed shoulder. The downside of this configuration is that it can restrict the any difference in thermal expansion between the collar and the internal components, caused, for example, by differences in material properties. In addition, this configuration makes changes in length of the internal assembly, for example to add additional components, more challenging as the collar locking features are matched to specific length of the overall internal assembly.

Yet another traditional solution is to slide the internal components into the collar and support the components by a number of spacer mounts attached to the internal components, where the spacer mounts centralize the components inside the collar and minimize the lateral movement of assembly. An example of such a system is disclosed in WO 2013/082376, entitled "Pressure Actuated Centralizer." In this configuration, the internal components include an axial thread that secures the components at one end to a corresponding thread in the collar. In order to allow assembly and disassembly of the components and to account for tolerance stack up, a small degree of radial clearance or radial compliance between the mounts and the collar is required. The downside of this solution is that the radial clearance or can cause shock amplification if lateral shock from the drilling process is transmitted from the collar to the internal assembly, whose mass is less than the collar. Shock amplification can lead to accelerated failure of the internal components.

Thus, there exists a need to address such shock amplification and to prolong the life of the internal components.

SUMMARY

Some embodiments of the present systems comprise a central body; at least one hydrostatically-actuatable assembly configured to extend radially outward from the central body, the hydrostatically-actuatable assembly having at least one piston body exposed to hydrostatic pressure; a plurality of passive structures, each of which is: configured to extend radially outward from the central body; and circumferentially spaced from the at least one hydrostatically-actuatable assembly and another one of the plurality of passive structures.

In some embodiments of the present systems, the at least one hydrostatically-actuatable assembly comprises a housing having a recess configured to receive the at least one piston body and wherein the at least one piston body is configured to be disposed within the recess of the housing such that the at least one piston body and the housing cooperate to define a sealed chamber therebetween.

Some embodiments of the present systems comprise an outer body within which the central body, the at least one hydrostatically-actuatable assembly, and the plurality of passive structures are disposed, and wherein, when the at least one piston body is exposed to a threshold hydrostatic pressure, the at least one hydrostatically-actuatable assembly is configured to move to contact an inner surface of the outer body to secure the central body relative to the outer body.

In some embodiments of the present systems, the at least one piston body has a first piston surface in communication with fluid in the chamber and a second piston surface in communication with fluid outside the central body.

In some embodiments of the present systems, the second piston surface is in communication with fluid in an annulus defined between the outer body and the central body.

In some embodiments of the present systems, the second piston surface has a surface area greater than a surface area of the first piston surface.

In some embodiments of the present systems, each of the passive structures are equidistantly spaced along the circumference of the central body from one another and from the at least one hydrostatically-actuatable assembly.

In some embodiments of the present systems, the central body comprises a longitudinal axis and each passive structure and hydrostatically-actuatable assembly is disposed at substantially the same position along the longitudinal axis of the central body.

Some embodiments of the present systems comprise an equal number of the hydrostatically-actuatable assemblies and passive structures.

Some embodiments of the present systems comprise an interface pad configured to be coupled to the at least one piston body, wherein the interface pad is movable relative to the housing between a retracted position and an extended position in response to the at least one piston body moving within the recess.

In some embodiments of the present systems, the chamber comprises fluid at atmospheric pressure. In some embodiments of the present systems, the chamber comprises ambient air.

In some embodiments of the present systems, at least one of the passive structures comprises a body having elastomeric material.

Some embodiments of the present hydrostatically-actuatable anchor mounts comprise a housing configured to extend from a central body having a central passageway, the housing having a recess configured to receive a piston body; a piston body configured to be disposed within the recess of the housing such that the piston body and the housing cooperate to define a sealed chamber therebetween, the piston body having: a first piston surface in communication with fluid in the chamber; a second piston surface sealed off from the chamber and the central passageway of the central body.

In some embodiments of the present the hydrostatically-actuatable anchor mounts, the second piston surface has a surface area greater than a surface area of the first piston surface.

Some embodiments of the present systems comprise an interface pad configured to be coupled to the piston body, wherein the interface is movable relative to the housing between a retracted position and an extended position in response to the piston body moving within the recess.

In some embodiments of the present the hydrostatically-actuatable anchor mounts, the chamber comprises fluid at atmospheric pressure. In some embodiments of the present the hydrostatically-actuatable anchor mounts, the chamber comprises ambient air.

In some embodiments of the present the hydrostatically-actuatable anchor mounts, the housing comprises a second recess configured to receive a second piston body, and further comprising a second piston body configured to be disposed within the second recess of the housing such that the second piston body and the housing cooperate to define a second sealed chamber therebetween, the second piston body having: a first piston surface in communication with fluid in the second chamber; a second piston surface sealed off from the second chamber and the central passageway of the central body.

Some embodiments of the present methods comprise coupling at least one hydrostatically-actuatable assembly to a central body, the hydrostatically-actuatable assembly having a piston body configured to be exposed to hydrostatic pressure; coupling a plurality of passive structures to the central body, wherein each of the plurality of passive structures are circumferentially spaced from one another and from the at least one hydrostatically-actuatable assembly; positioning the at least one hydrostatically-actuatable assembly, the plurality of passive structures, and the central body within an outer body; exposing the piston body to hydrostatic pressure such that the piston body causes the at least one hydrostatically-actuatable assembly to contact an inner surface of the outer body to secure the central body relative to the outer body.

Some embodiments of the present methods comprise mounting the hydrostatically-actuatable anchor mount to a central body. Some embodiments of the present methods comprise positioning the system into a borehole of a formation.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The phrase "and/or" means and or or. To illustrate, A, B, and/or C includes: A alone, B alone, C alone, a combination of A and B, a combination of A and C, a combination of B and C, or a combination of A, B, and C. In other words, "and/or" operates as an inclusive or.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Further, a device or system that is configured in a certain way is configured in at least that way, but it can also be configured in other ways than those specifically described.

Some details associated with the embodiments described above and others are described below.

DETAILED DESCRIPTION OF ILLUSTRATIVE EMBODIMENTS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

Figure 1:
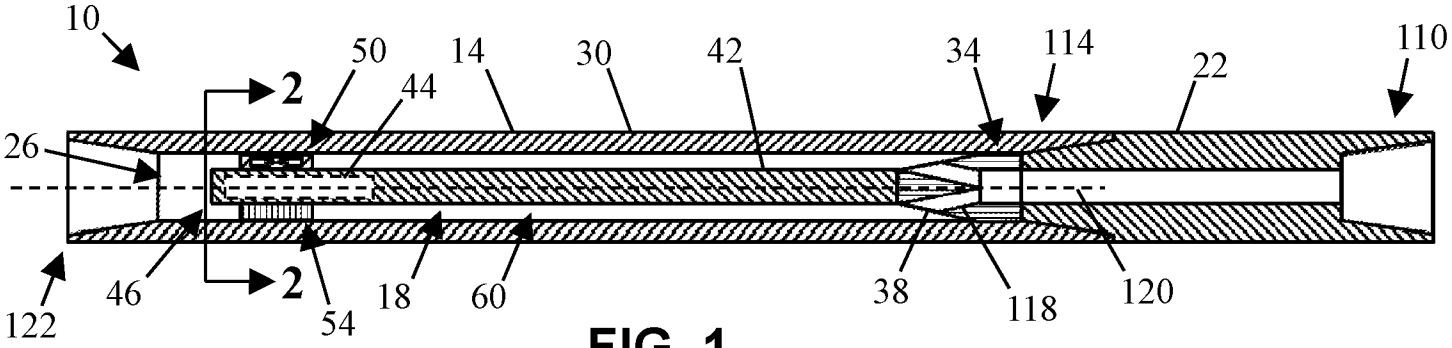
FIG. 1 depicts a cross-sectional side view of one embodiment of the present systems, taken along line 1-1 of FIG. 2.
Figure 2:
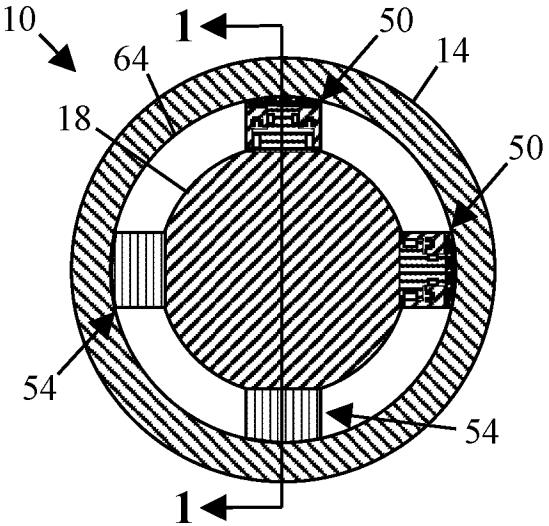
FIG. 2 depicts a cross-sectional end view of the system of FIG. 1.

Referring now to the figures, and more particularly, to FIGS. 1 and 2, shown therein and designated by reference numeral 10 is an embodiment of the present systems, such as, for example, a bottom hole assembly. As shown, system 10 comprises an outer body 14 and a central body 18 disposed within the outer body.

In this embodiment, outer body 14 comprises a collar that can be coupled at opposing ends to one or more segments of pipe 22, such as for example a drill pipe and/or a sub, and tripped downhole during drilling operations. As shown in FIG. 1, outer body 14 comprises a conduit 26 defined by a sidewall 30 of the outer body. Central body 18 is disposed within conduit 26 and is secured to outer body 14 at a first end 34 of the central body. In this embodiment, central body 18 includes a flow diverter 38 at first end 34, which is coupled to a central body housing 42 and outer body 14. Central body 18 can be coupled to outer body 14 (e.g., at first end 34) in any suitable fashion, such as by a threaded coupling or by one or more fasteners. As shown, central body 18 includes a second, free end 46 that is not secured to outer body 14.

Central body housing 42 can be configured to accommodate therein (e.g., in a chamber 44) one or more measurement devices, such as, for example, measurement-while-drilling ("MWD") devices, logging-while-drilling ("LWD") devices, and/or the like, to record and/or transmit formation measurements during the drilling process.

In some embodiments, a system (e.g., 10) can comprise a rotatable steering system (RSS) coupled to pipe (e.g., 22) to control the direction of drilling and allow accurate wellbore placement along a predetermined path. In some such embodiments, a central body (e.g., 18) within the RSS can comprise a chamber (e.g., 44) that includes therein one or more electrical and/or mechanical components to be protected from lateral shock and vibration as disclosed herein.

System 10 includes one or more hydrostatically-actuatable assemblies 50 and a plurality of passive structures 54 configured to be disposed within conduit 26 of outer body 14, and more particularly, within an annulus 60 between central body 18 and the outer body. As described herein, one or more hydrostatically-actuatable assemblies 50 and passive structures 54 cooperate to secure central body 18 to outer body 14 in order to protect the measurement devices within central body housing 42 from lateral shock and vibration imparted on the central body during the wellbore creating process (e.g., impacts between outer body 14 and/or pipe 22 and the wellbore, impacts between a drill bit and the wellbore, and/or the like). Such lateral shock and vibration may otherwise compromise the effectiveness and/or integrity of the measurement devices within central body housing 42.

In order to reduce such lateral shock and vibration, each hydrostatically-actuatable assembly 50 and passive structure 54 is configured to contact an inner surface 64 of sidewall 30 of outer body 14 in order to restrict lateral movement of second end 46 of central body 18 relative to the outer body as described herein. Each assembly 50 and passive structure 54 can be coupled to central body 18 at any suitable position along a length of the central body in order to achieve the desired reduction of lateral shock and vibration, such as, for example, at or proximate to second end 46 of the central body.

Figure 3:
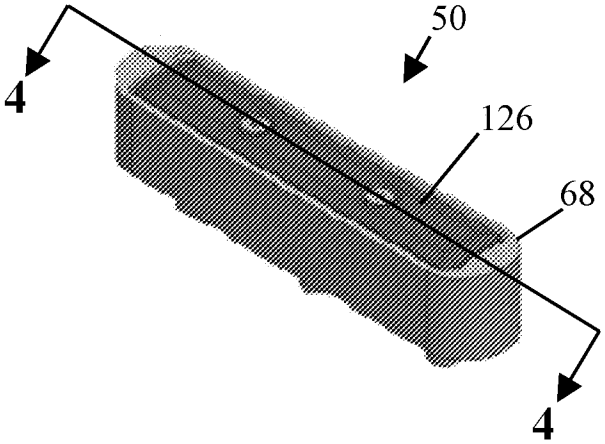
FIG. 3 depicts a perspective view of one embodiment of the present hydrostatically-actuatable assemblies which may be suitable for use in the system of FIG. 1.
Figure 4:
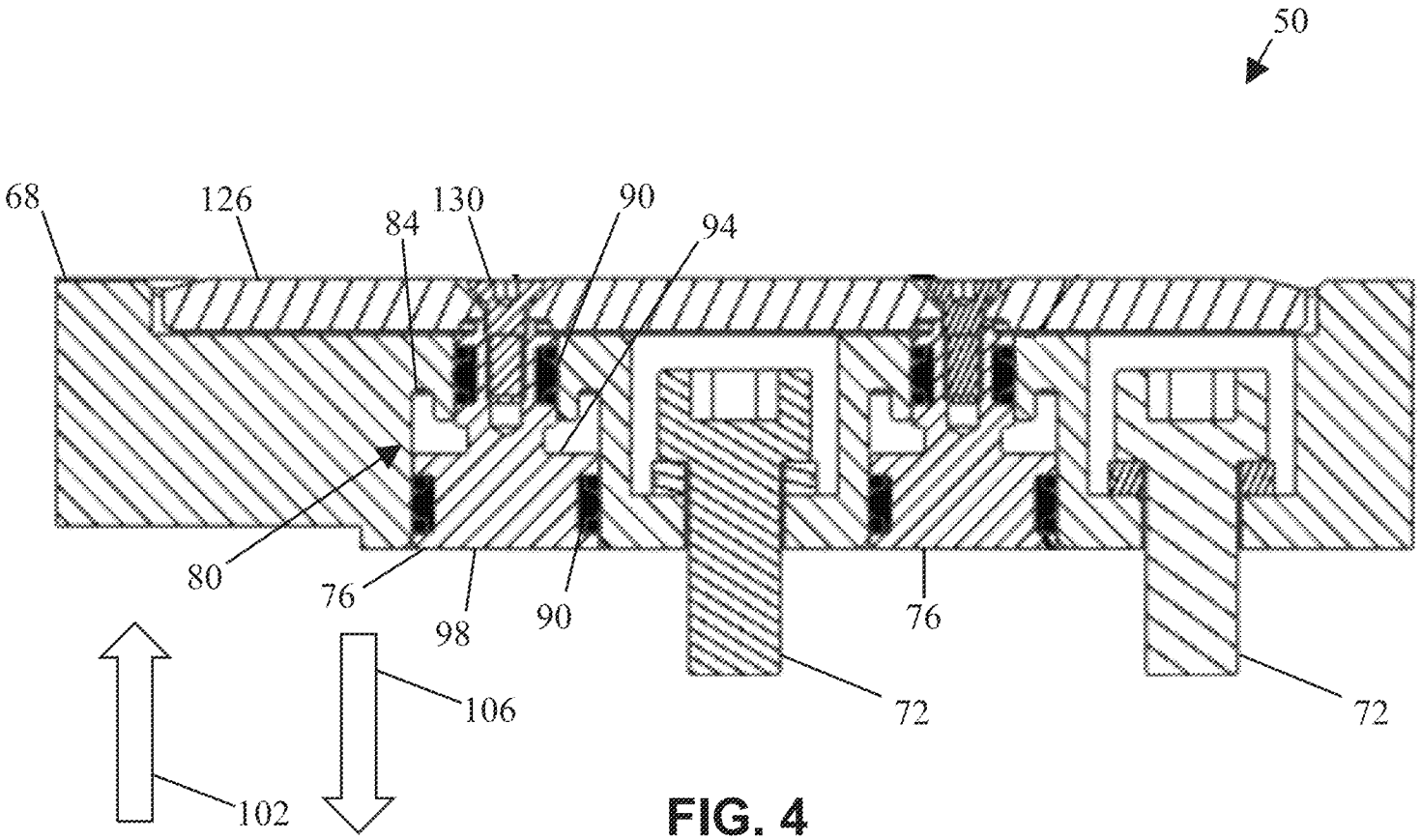
FIG. 4 depicts a cross-sectional side view of the assembly of FIG. 3, taken along line 4-4 of FIG. 3.
Figure 5:
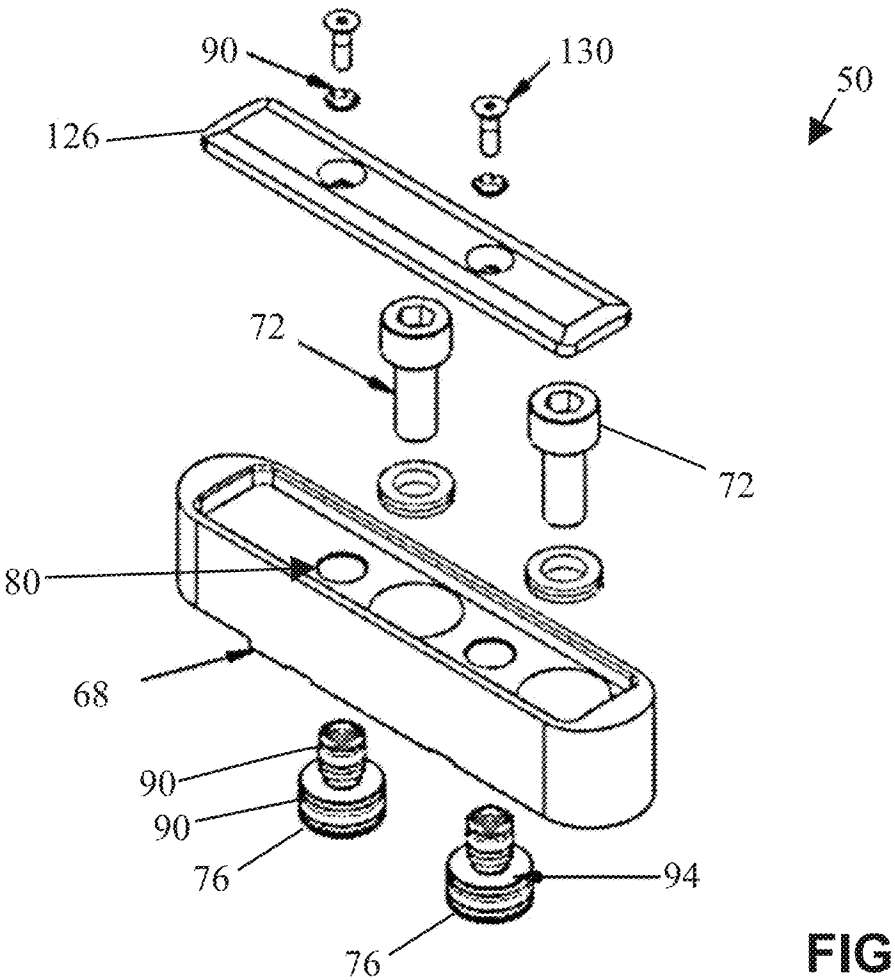
FIG. 5 depicts a perspective exploded view of the assembly of FIG. 3.

Each hydrostatically-actuatable assembly 50 is configured to extend radially outward from central body 18. As shown in FIGS. 3-5, one or more hydrostatically-actuatable assemblies 50 can comprise an assembly housing 68 configured to be coupled to central body housing 42 (e.g., by one or more fasteners 72). When coupled to central body housing 42, assembly housing 68 is configured to extend radially outward from central body 18.

Each assembly 50 includes one or more piston bodies 76, each of which are configured to be received in respective a recess 80 of assembly housing 68. To illustrate, piston body 76 is configured to be disposed within recess 80 of assembly housing 68 such that the piston body and the assembly housing cooperate to define a chamber 84 of compressible fluid therebetween. Assembly chamber 84 is configured to be sealed off from fluid within annulus 60 by a plurality of seals 90 (e.g., one or more elastomeric o-rings). For example, piston body 76 includes a first piston surface 94 in communication with compressible fluid in chamber 84 and a second piston surface 98 sealed off from the chamber. Assembly chamber 84 can comprise any suitable compressible fluid at atmospheric pressure. For example, assembly 50 can be assembled at surface such that piston body 76 and assembly housing 68 are coupled to capture ambient air within assembly chamber 84. As shown, for example, in FIGS. 4 and 5, a surface area of first piston surface 94 (i.e., the surface area of piston body 76 that, when exposed to fluid, causes the piston body to exert a force in a first direction 102) is greater than a surface area of second piston surface 98 (i.e., the surface area of the piston body that, when exposed to fluid, causes the piston body to exert a force in a second direction 106 that is opposite the first direction).

Although each assembly 50 is coupled to central body 18, each assembly (e.g., in its entirety) can be sealed off from fluid central body chamber 44. Thus, each assembly 50 is exposed only to fluid within annulus 60.

Each hydrostatically-actuatable assembly 50 is configured to respond to fluid forces within annulus 60 to secure central body 18 (e.g., at or near second end 46) to outer body 14. For example, as drilling mud is circulated during the drilling process, the drilling mud may enter pipe 22 at a first end 110 thereof and travel toward central body 18 and outer body 14 (i.e., towards the surface of the formation). The drilling mud may enter a first end 114 of outer body 14 and flow into one or more passages 118 of central body 18 to direct the mud around the central body. The drilling mud can subsequently flow out of a second end 122 of outer body 14 towards the surface. By virtue of assembly 50 being within annulus 60 during the drilling process, a column of drilling fluid within the annulus exerts hydrostatic forces on the assembly. In this instance, hydrostatic pressure is pressure that is exerted by fluid in a wellbore due to the force of gravity. Hydrostatic pressure increases in proportion to wellbore depth measured from surface because of the increasing weight of fluid exerting a downward force from above.

As shown in FIG. 4, second piston surface 98 of piston body 76 is configured to be in communication with fluid in annulus 60 when assembly 50 is coupled to central body 18 and system 10 is tripped into a wellbore. When second piston surface 98 of piston body 76 is exposed to a threshold pressure within annulus 60, the piston body moves radially outward (i.e., away from central body 18) and compresses the fluid within chamber 84. In turn, piston body 76 causes assembly 50 to come in contact with inner surface 64 of outer body 14 to secure the central body to the outer body. As shown, assembly 50 can include one or more interface pads 126 configured to be coupled to piston body 76 (e.g., by one or more fasteners 130). By virtue of being coupled to piston body 76, interface pad 126 is configured to be movable relative to assembly housing 68 between a retracted position and an extended position, in which the interface pad extends further from the assembly housing than in the retracted position, in response to the piston body exposed to fluid pressure within annulus 60 and moving within recess 80.

Components (e.g., 68, 72, 76, 126, 130) of each assembly 50 can be manufactured from a wide variety of materials, including metal (e.g., any suitable grades of stainless steels, whether magnetic or non-magnetic, tool steels, alloy steels with suitable anti corrosion protection, aluminum, titanium, copper-based alloys, and/or the like), hard elastomers (e.g., plastics), and/or the like. Materials for the components of assembly 50 can be selected based upon a specific downhole application, spacing within conduit of outer body 14, fluid compatibility, mass of central body 18, expected magnitude of shock and/or vibration, magnitude of hydrostatic pressure, and/or the like. Interface pads 126 can comprise friction-enhancing materials (e.g. elastomers) and/or surface treatments (e.g. shot peening) to reduce relative movement under load between central body 18 and outer body 14.

As shown in FIG. 2, each passive structure 54 can be configured to be coupled to central body 18 by one or more fasteners such that the passive structure extends radially outward from the central body. In some embodiments, one or more passive structures (e.g., 54) are integral to a central body (e.g., 18). Passive structure(s) 54 can comprise any suitable spring and/or damping material, such as, for example, an elastomeric material.

Figure 7:
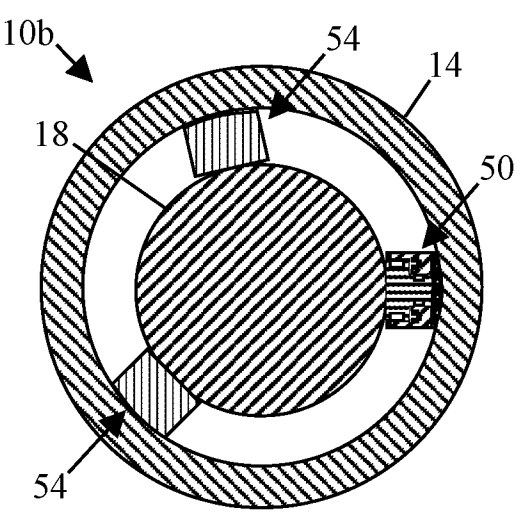
FIG. 7 depicts a cross-sectional end view of a third embodiment of the present systems.
Figure 6:
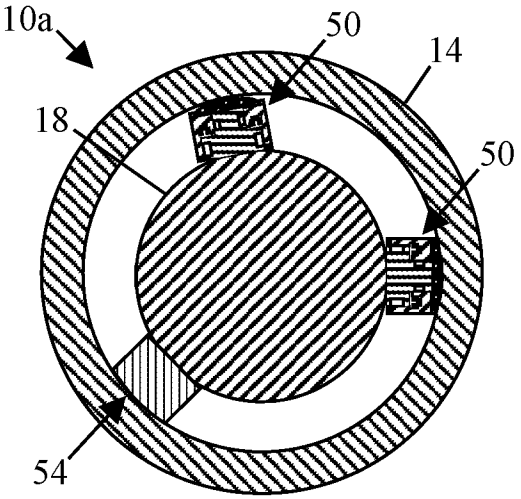
FIG. 6 depicts a cross-sectional end view of a second embodiment of the present systems.

As shown in FIG. 2, passive structures 54 and assembly(ies) 50 can be circumferentially spaced from one another, such as, for example, equidistantly spaced along a periphery, of central body 18. In other embodiments, a circumferential spacing between any two passive structures (e.g., 54) and/or any two assemblies (e.g., 50), as measured along a circle centered on a longitudinal axis (e.g., 120) of a central body (e.g., 18) can be approximately any one of the following: 30, 45, 60, 75, 90, 105, 120, 135, and 150 degrees. Passive structures 54 and assembly(ies) 50 can be circumferentially arranged about longitudinal axis 120 of central body 18 such that, in response to lateral shock and vibration imparted on the central body during the wellbore creating process (e.g., impacts between outer body 14 and/or pipe 22 and the wellbore, impacts between a drill bit and the wellbore, and/or the like), at least one of the passive structures cooperates with at least one of the assemblies to absorb such lateral shock and/or vibration as disclosed herein. For example, as shown in FIG. 2, at least one assembly 50 and passive structure 54 can be positioned on central body 18 opposite relative to one another. For further example, as shown in FIG. 6, in some embodiments, a system (e.g., 10*a*) can comprise two assemblies (e.g., 50) and one passive structure (e.g., 54), each spaced equidistantly from an adjacent assembly or structure around a central body (e.g., 18) (i.e., approximately 120 degrees apart, as measured circumferentially around the central body). For yet further example, as shown in FIG. 7, in some embodiments, a system (e.g., 10*b*) can comprise one assembly (e.g., 50) and two passive structures (e.g., 54), each spaced equidistantly from an adjacent assembly or structure other around a central body (e.g., 18) (i.e., approximately 120 degrees apart, as measured circumferentially around the central body).

System 10 can have any suitable number of passive structures 54 and assembly(ies) 50 to achieve the desired reduction in lateral shock and/or vibration described herein. For example, system 10 can include one, two, three, four, or more assemblies 50 and one, two, three, four, or more passive structures 54 and any suitable combination of assemblies and passive structures, including an equal number of passive structures and assemblies 50. Each passive structure 54 and assembly 50 can be coupled to central body 18 at any suitable position along the length of central body. One or more passive structures 54 and one or more assemblies 50 can be axially aligned along longitudinal axis (e.g., as shown in FIG. 1), or they can be staggered along the longitudinal axis.

As system 10 is lowered into a wellbore (e.g., during a drilling operation) and fluid, such as drilling mud, fills annulus 60 as described herein, a column of the fluid above assembly 50 increases and causes a force (corresponding to the hydrostatic pressure of the fluid at assembly 50) to act on the assembly. When such a force meets or exceeds a threshold value, the fluid force causes piston body 76 to move in first direction 102 (i.e., away from central body 18). In turn, interface pad 126 moves toward an extended position and contacts inner surface 64 of outer body 14. After assembly 50 makes contact with inner surface 64 of outer body 14, piston body 76 does not continue to compress fluid within assembly chamber 84. Rather, the hydrostatic pressure of the fluid column causes assembly 50 to exert a force (a "locking force" or "$F_1$") against outer body 14 that is proportional to the difference between the surface areas of first piston surface 94 and second piston surface 98. Such locking force prevents relative movement between central body 18 and outer body 14 as long as the locking force exceeds the force ("$F_2$") of any lateral shock and/or vibration impact, which can be characterized by the following equation: $F_1>F_2=m_1a_1$, where $m_1$ is the mass of central body 18 and $a_1$ is the acceleration of the central body as generated by the lateral shock and/or vibration.

Importantly, a resultant force of each hydrostatically-actuatable assembly 50 must be counteracted by a resultant force of one or more passive structures 54 in order to avoid cancelling out the locking force of the assembly in response to lateral shock and/or vibration. To illustrate, each assembly (e.g., 50) can be analogized to a spring assembly. Although the assembly (e.g., 50) can exert a strong locking force against the outer body (e.g., 14), the "stiffness" exhibited by the assembly, and as defined by the fluid in the assembly chamber (e.g., 84), is relatively low. For example, since the travel of a piston body (e.g., 76) is very limited, very little compression of the fluid within chamber (e.g., 84) is required before an assembly (e.g., 50) contacts an outer body (e.g., 14). Instead, frictional drag between piston seals (e.g., 90) and a housing (e.g., 68) will be the main source force resisting movement of piston body (e.g., 76).

A potential issue may arise where two assemblies (e.g., 50) having piston bodies (e.g., 76) with similar or identical piston surface areas (e.g., 94, 98) are positioned opposite one another on the central body (e.g., 18). In other words, the assemblies (e.g., 50) would be acting as springs in parallel. In this instance, the locking forces of the two assemblies (e.g., 50) would be balanced. However, due to the relatively low "stiffness" exhibited by each assembly (e.g., 50), the central body (e.g., 18) would be able to move back and forth in response to lateral shock and/or vibrations with little resistance from the assemblies. That is, irrespective of the relatively high locking force, displacing the central body (e.g., 18) by a small distance would require only a relatively small force. As such, even a small lateral shock and/or vibration would be amplified in such a situation. In order to avoid this phenomenon, the force exerted on outer body 14 by assembly 50 is counteracted by the force exerted on the outer body by a plurality of passive structures 54. In at least this way, the locking force of assembly 50 is not cancelled out by another component of system 10 and lateral shock and/or vibration is indeed dampened by the cooperation of opposing passive structure(s) 54 and assembly(ies) 50.

To assemble system 10, central body housing 42 can be coupled to flow diverter 38. One or more assemblies 50 and a plurality of passive structures 54 can be coupled to central body 18. Then, central body 18 can be coupled to outer body 14. Outer body 14 can be coupled to pipe 22, such as, for example, to a steering sub. When central body 18 is coupled to outer body 14, assembly(ies) 50 and passive structures 54 cooperate to allow sufficient radial clearance between the central body and the outer body for easy assembly. Then, system 10 can be lowered into a wellbore, wherein the resulting hydrostatic pressure from fluid within the wellbore causes assembly(ies) 50 to extend radially outward away from central body 18, as disclosed herein, and secure central body 18 relative to outer body 14. In at least this way, assembly(ies) 50 and passive structures 54 cooperate to reduce lateral shock amplification that would otherwise occur as shocks are transmitted from outer body 14 (having a high mass) to inner body (having a low mass). Further, in at least this way, assembly(ies) 50 and passive structures 54 cooperate to increase friction between the assembly(ies) and passive structures and outer body 14 in order to reduce the effect of torsional vibration and stick slip generated during a drilling process, which can be transmitted from pipe 22 to central body 18.

Some embodiments of the present methods include coupling at least one hydrostatically-actuatable assembly (e.g., 50) to a central body (e.g., 18), the hydrostatically-actuatable assembly having a piston body (e.g., 76) configured to be exposed to hydrostatic pressure; coupling a plurality of passive structures (e.g., 54) to the central body, wherein each of the plurality of passive structures are circumferentially spaced from one another and from the at least one hydrostatically-actuatable assembly; positioning the at least one hydrostatically-actuatable assembly, the plurality of passive structures, and the central body within an outer body (e.g., 14); exposing the piston body to hydrostatic pressure such that the piston body causes the at least one hydrostatically-actuatable assembly to contact an inner surface (e.g., 64) of the outer body to secure the central body relative to the outer body.

Some embodiments comprise mounting the present hydrostatically-actuatable anchor assembly (e.g., 50) to a central body (e.g., 18).

Some embodiments comprise positioning the present system (e.g., 10) into a borehole of a formation.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments. For example, embodiments of the present methods and systems may be practiced and/or implemented using different structural configurations, materials, ionically conductive media, monitoring methods, and/or control methods.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A system, comprising:

a central body defining a chamber;

at least one hydrostatically-actuatable assembly sealed off from the chamber and configured to extend radially outward from the central body, the hydrostatically-actuatable assembly having at least one piston body exposed to hydrostatic pressure;

a plurality of passive structures, each of which is:

configured to extend radially outward from the central body; and circumferentially spaced from the at least one hydrostatically-actuatable assembly and another one of the plurality of passive structures;

wherein:

the at least one hydrostatically-actuatable assembly comprises a housing having a recess configured to receive the at least one piston body; and the housing is fixed relative to the central body.

2. The system of claim 1, wherein the at least one one piston body is configured to be disposed within the recess of the housing such that the at least one piston body and the housing cooperate to define a sealed chamber therebetween.

3. The system of claim 2, comprising:

an outer body within which the central body, the at least one hydrostatically-actuatable assembly, and the plurality of passive structures are disposed, and wherein, when the at least one piston body is exposed to a threshold hydrostatic pressure, the at least one hydrostatically-actuatable assembly is configured to move to contact an inner surface of the outer body to secure the central body relative to the outer body.

4. The system of claim 3, wherein the at least one piston body has a first piston surface in communication with fluid in the chamber and a second piston surface in communication with fluid outside the central body.

5. The system of claim 4, wherein the second piston surface is in communication with fluid in an annulus defined between the outer body and the central body.

6. The system of claim 4, wherein the second piston surface has a surface area greater than a surface area of the first piston surface.

7. The system of claim 3, comprising an interface an interface pad configured to be coupled to the at least one piston body, and wherein:

the interface pad is movable relative to the housing between a retracted position and an extended position in response to the at least one piston body moving within the recess; and the interface pad is configured to contact the outer body when in the extended position.

8. The system of claim 2, wherein the chamber comprises fluid at atmospheric pressure.

9. The system of claim 8, wherein the chamber comprises ambient air.

10. The system of claim 1, wherein each of the passive structures are equidistantly spaced along the circumference of the central body from one another and from the at least one hydrostatically-actuatable assembly.

11. The system of claim 1, wherein the central body comprises a longitudinal axis and each passive structure and hydrostatically-actuatable assembly is disposed at substantially the same position along the longitudinal axis of the central body.

12. The system of claim 1, wherein the system comprises an equal number of the hydrostatically-actuatable assemblies and passive structures.

13. The system of claim 1, wherein at least one of the passive structures comprises a body having elastomeric material.

14. A hydrostatically-actuatable anchor mount comprising:

a housing configured to extend from a central body having a central passageway, the housing having a recess configured to receive a piston body;

a piston body configured to be disposed within the recess of the housing such that the piston body and the housing cooperate to define a sealed chamber therebetween, the piston body having:

a first piston surface in communication with fluid in the chamber; and a second piston surface sealed off from the chamber and the central passageway of the central body;

wherein the piston body is configured to move outward when a first force resulting from a fluid pressure acting on the second piston surface is greater than a second force resulting from the fluid pressure in the chamber.

15. The mount of claim 14, wherein the second piston surface has a surface area greater than a surface area of the first piston surface and when the second piston surface is exposed to a threshold pressure the piston body moves away from central body and compresses a fluid within the sealed chamber.

16. The assembly of claim 14, comprising an interface pad configured to be coupled to the piston body, wherein the interface is movable relative to the housing between a retracted position and an extended position in response to the piston body moving within the recess.

17. The mount of claim 14, wherein the chamber comprises fluid at atmospheric pressure.

18. The system of claim 17, wherein the chamber comprises ambient air.

19. The mount of claim 16, wherein:

the housing comprises a second recess configured to receive a second piston body, and further comprising a second piston body configured to be disposed within the second recess of the housing such that the second piston body and the housing cooperate to define a second sealed chamber therebetween, the second piston body having:

a first piston surface in communication with fluid in the second chamber; and a second piston surface sealed off from the second chamber and the central passageway of the central body.

20. A method comprising:

coupling at least one hydrostatically-actuatable assembly to a central body such that the hydrostatically-actuatable assembly is sealed off from a chamber defined by the central body, the hydrostatically-actuatable assembly having a piston body configured to be exposed to hydrostatic pressure;

coupling a plurality of passive structures to the central body, wherein each of the plurality of passive structures are circumferentially spaced from one another and from the at least one hydrostatically-actuatable assembly;

positioning the at least one hydrostatically-actuatable assembly, the plurality of passive structures, and the central body within an outer body; and exposing the piston body to hydrostatic pressure such that the piston body causes the at least one hydrostatically-actuatable assembly to contact an inner surface of the outer body to secure the central body relative to the outer body;

wherein the piston body is configured to move outward when exposed to a threshold hydrostatic pressure.

* * * * *